US011779790B2

(12) United States Patent
Merrithew et al.

(10) Patent No.: US 11,779,790 B2
(45) **Date of Patent: *Oct. 10, 2023**

(54) ADJUSTABLE REFORMER

(71) Applicant: Merrithew International Inc., Toronto (CA)

(72) Inventors: Lindsay G. Merrithew, Toronto (CA); Moira M. Merrithew, Toronto (CA); Viral Bhatt, Markham (CA); Carlos Baez, Toronto (CA)

(73) Assignee: Merrithew International Inc., Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/740,482

(22) Filed: May 10, 2022

(65) Prior Publication Data

US 2022/0370850 A1 Nov. 24, 2022

Related U.S. Application Data

(63) Continuation of application No. 16/854,982, filed on Apr. 22, 2020, now Pat. No. 11,358,018, which is a (Continued)

(51) Int. Cl.
*A63B 21/02* (2006.01)
*A63B 21/055* (2006.01)
(Continued)

(52) U.S. Cl.
CPC ..... *A63B 21/023* (2013.01); *A63B 21/00* (2013.01); *A63B 21/0552* (2013.01); *A63B 21/154* (2013.01); *A63B 21/156* (2013.01); *A63B 21/4031* (2015.10); *A63B 22/0089* (2013.01); *A63B 22/203* (2013.01);
(Continued)

(58) Field of Classification Search
CPC ..... A63B 21/023; A63B 21/00; A63B 22/203; A63B 21/0552; A63B 21/156; A63B 23/03525; A63B 23/03541; A63B 23/0355; A63B 23/03575; A63B 23/0405;
(Continued)

(56) References Cited

U.S. PATENT DOCUMENTS 2,733,922 A 2/1956 Diego
4,272,074 A 6/1981 Sferle
(Continued)

FOREIGN PATENT DOCUMENTS

GB 1118690 7/1968
WO 2004096376 A1 11/2004

OTHER PUBLICATIONS http://www.youtube.com/watch?v=9OooKlpgUL4, published Dec. 13, 2006, last visited Jun. 5, 2018.
(Continued)

*Primary Examiner* — Andrew S Lo

(57) ABSTRACT

An adjustable reformer for exercising is provided. The reformer includes a frame, a carriage slidably mounted to the horizontal frame, and at least one resistance element connected to the carriage. A cord connects the carriage to at least one lower guide and at least one upper guide. Pulling the cord causes movement of the carriage along the frame against resistance provided by the resistance element. The guides can be height adjustable. The reformer can include a cord retraction system. Related methods of exercise are also provided.

31 Claims, 11 Drawing Sheets

Related U.S. Application Data continuation of application No. 15/419,007, filed on Jan. 30, 2017, now Pat. No. 10,653,912, which is a continuation of application No. 14/614,907, filed on Feb. 5, 2015, now abandoned, which is a continuation of application No. 12/974,156, filed on Dec. 21, 2010, now abandoned, which is a continuation of application No. 12/054,796, filed on Mar. 25, 2008, now Pat. No. 7,857,736.

(51) Int. Cl.

| | |
|---|---|
| ***A63B 21/00*** | (2006.01) |
| ***A63B 23/035*** | (2006.01) |
| ***A63B 23/04*** | (2006.01) |
| ***A63B 23/12*** | (2006.01) |
| ***A63B 22/20*** | (2006.01) |
| ***A63B 22/00*** | (2006.01) |
| ***A63B 21/04*** | (2006.01) |

(52) U.S. Cl.

CPC .... *A63B 23/0355* (2013.01); *A63B 23/03525* (2013.01); *A63B 23/03541* (2013.01); *A63B 23/03575* (2013.01); *A63B 23/0405* (2013.01); *A63B 23/1263* (2013.01); *A63B 21/00065* (2013.01); *A63B 21/00069* (2013.01); *A63B 21/0428* (2013.01); *A63B 21/0442* (2013.01); *A63B 2225/093* (2013.01)

(58) Field of Classification Search

CPC ..... A63B 23/1263; A63B 21/00065; A63B 21/00069; A63B 21/0428; A63B 21/0442

See application file for complete search history.

(56) References Cited

U.S. PATENT DOCUMENTS

| | | | |
|---|---|---|---|
| 4,383,684 | A | 5/1983 | Schliep |
| 4,709,918 | A | 1/1987 | Grinblat |
| 4,706,953 | A | 11/1987 | Graham |
| 4,911,438 | A | 3/1990 | Van Straaten |
| 5,066,005 | A | 11/1991 | Luecke |
| 5,792,033 | A | 8/1998 | Merrithew |
| 5,906,564 | A | 5/1999 | Jacobsen |
| 7,104,937 | B2 | 9/2006 | Arbuckle et al. |
| 7,104,939 | B1 | 9/2006 | Martinez |
| 7,125,369 | B2 | 10/2006 | Endelman |
| 7,125,370 | B1 | 10/2006 | Schaffner et al. |
| 7,137,936 | B1 | 11/2006 | Shaw et al. |
| 7,163,498 | B1 | 1/2007 | Abelbeck |
| 7,179,207 | B2 | 2/2007 | Gerschefske |
| 7,288,054 | B2 | 10/2007 | Endelman et al. |
| 7,465,261 | B2 | 12/2008 | Barnard et al. |
| 7,503,880 | B2 | 3/2009 | Campanaro et al. |
| 7,850,584 | B2 | 12/2010 | Uygan |
| 8,475,346 | B2 | 7/2013 | Gerschefske et al. |
| 2002/0132706 | A1 | 9/2002 | Sleamaker |
| 2002/0151416 | A1 | 10/2002 | List |
| 2004/0009849 | A1 | 1/2004 | Galbraith et al. |
| 2004/0248713 | A1 | 12/2004 | Campanaro et al. |
| 2005/0113226 | A1 | 5/2005 | Endelman et al. |
| 2005/0113227 | A1 | 5/2005 | Endelman et al. |
| 2008/0171643 | A1 | 7/2008 | Baudhuin |
| 2008/0248935 | A1 | 10/2008 | Solow et al. |
| 2009/0118108 | A1 | 5/2009 | Uygan |
| 2009/0215594 | A1 | 8/2009 | Panaiotov |

OTHER PUBLICATIONS

Lauren Murphy, Graceful Gut Work, Key to Pilates Is Strength at the Core, Fox News channel, Oct. 8, 1999 found at http://www.williamtolan.com/fno/fitness/pilates.htm, last visited Apr. 4, 2016.

ADJUSTABLE REFORMER

This application is a continuation of application Ser. No. 16/854,982, filed Apr. 22, 2020, which is a continuation of application Ser. No. 15/419,007, filed Jan. 30, 2017, now U.S. Pat. No. 10,653,912, which is a continuation of application Ser. No. 14/614,907, filed Feb. 5, 2015, which is a continuation of application Ser. No. 12/974,156, filed Dec. 21, 2010, which is a continuation of application Ser. No. 12/054,796, filed Mar. 25, 2008, now U.S. Pat. No. 7,857,736, and the entire contents of each of which are incorporated herein by reference.

The section headings used herein are for organizational purposes only and are not to be construed as limiting the subject matter described in any way.

FIELD

The teaching disclosed herein relates to exercise equipment, and in particular to reformers.

INTRODUCTION

U.S. Pat. No. 5,066,005 (Luecke) describes an enhanced core movement training bench including an adjustable arm cord mounting assembly, an adjustable footbar assembly, and a jump board attachment. The arm cord mounting system includes a pair of elongated flexible arm cords each entrained over a lower fixed height guide and an upper variable height guide mounted for adjustable movement along a vertical slot in each upright corner post at one end of the bench frame, thereby permitting infinite adjustment of the vertical positions above the frame of the upper guides and the portions of the arms cords extending from the corner posts to the user. Adjustable anchoring devices attach the cords to the mobile carriage for infinitely adjusting the effective lengths of the cords. These adjustment capabilities of the adjustable arm cord mounting assembly enable a user to quickly and easily select a suitable position on the platform of the mobile carriage and to tailor the bench to accommodate a range of motions corresponding to the user's particular body size. In such manner, a fixed setup location, as provided in the traditional prior art bench, is not permitted to dictate or influence the pattern of user movement.

SUMMARY

In various embodiments, a reformer is provided including: a frame including a horizontal frame having first and second ends, and a vertical frame secured to the horizontal frame proximate to the first end and extending upward from the horizontal frame; a carriage slidably mounted to the horizontal frame so as to reciprocate between the first and second ends; a resistance element attached to the carriage for biasing the carriage to an equilibrium position between the first and second ends; at least one lower guide mounted at a position proximate to the first end of the horizontal frame; at least one upper guide adjustably mounted to the vertical frame; and a cord connecting the carriage, the lower guide, and the upper guide.

In various embodiments, a reformer is provided including: a horizontal frame having first and second ends; a carriage slidably mounted to the horizontal frame so as to reciprocate between the first and second ends; a resistance element attached to the carriage for biasing the carriage toward an equilibrium position between the first and second ends; at least one guide mounted at a position proximate to the first end of the horizontal frame; a cord connecting the carriage and the guide; and a cord retraction system mounted to the carriage, the cord retraction system receiving an end of the cord.

A method of exercise is also provided including: providing a reformer including a horizontally slidable carriage, a vertically adjustable guide, and a cord connecting the carriage and the guide; adjusting the guide to one of a plurality of heights; getting on the carriage; and pulling a distal end of a cord along a range of motion, the cord connecting the carriage and the upper guide such that pulling the cord causes horizontal movement of the carriage.

These and other features of the applicant's teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in any way. In the drawings.

DETAILED DESCRIPTION

Numerous specific details are set forth in order to provide a thorough understanding of the example embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementation of the various embodiments described herein. The embodiments described herein are not intended to be limited to the specific details of any one-example embodiment or to specific details that may be common to multiple, or all, example embodiments. The applicant(s), inventor(s) and/or owner(s) reserve all rights that they may have in any embodiments disclosed herein, for example the right to embodiments claimed in a continuing application, and do not intend to abandon, disclaim or dedicate to the public any such embodiments by disclosure of this document.

Figure 1:
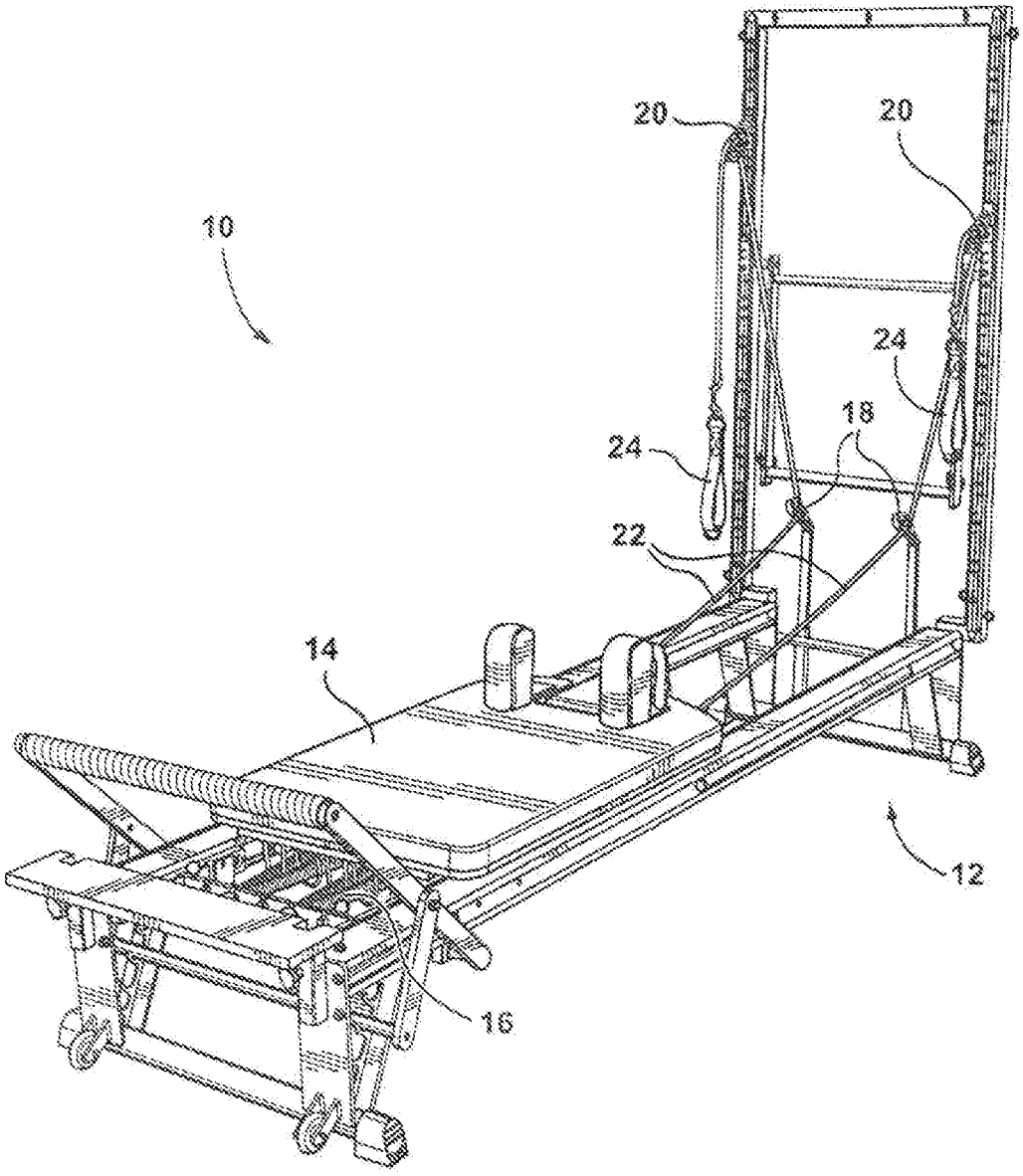
FIG. 1 is a perspective view of a reformer including a horizontal frame and a vertical frame.

Referring to FIG. 1, illustrated therein is a reformer 10. The reformer 10 includes a frame 12, a carriage 14 slidably mounted to the frame 12, and at least one resistance element 16 connected between the frame 12 and the carriage 14 for biasing the carriage 14 to an equilibrium position along the frame 12. At least one lower guide 18 and at least one upper guide 20 are provided. At least one cord 22 connects the carriage 14, the lower guide 18, and the upper guide 20. A reformer loop 24 can be provided at the end of the cord 22. As illustrated, the reformer 10 can include two lower guides 18, two upper guides 20, and two cords 22, each cord 22 being attached to the carriage 14. In general, pulling the cord 22 causes movement of the carriage 14 along the frame 12 against resistance provided by the resistance element 16.

Figure 2:
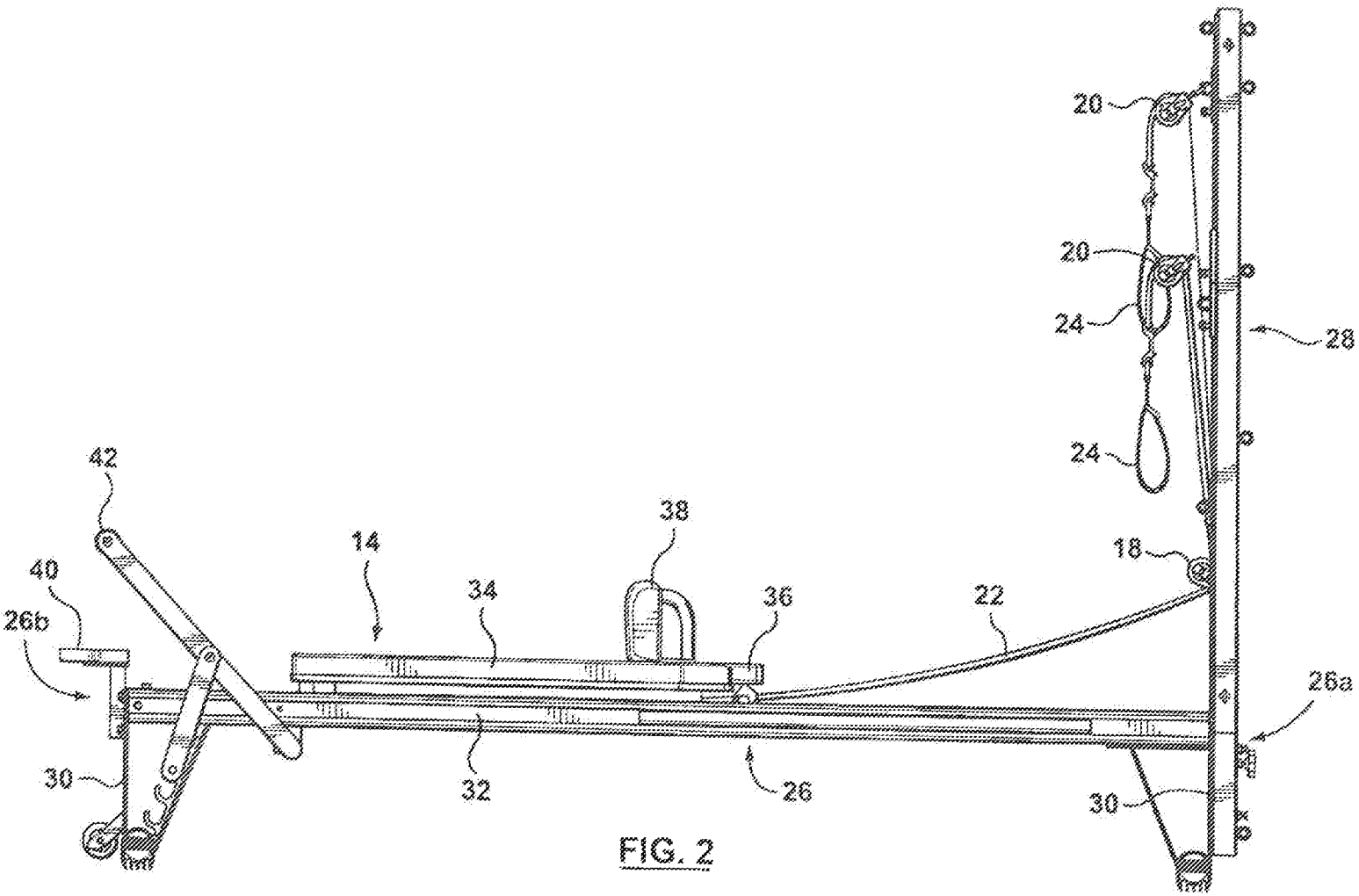
FIG. 2 is a side elevation view of the reformer of FIG. 1.

Referring to FIG. 2, the frame 12 can include a horizontal frame 26 having a first end 26*a* and a second end 26*b*, and a vertical frame 28 extending upward from the horizontal frame 26. The vertical frame 28 can be positioned or secured to the horizontal frame 26 at or near the first end 26*a*.

The horizontal frame 26 can serve generally as a base for other components of the reformer 10. As illustrated, the horizontal frame 26 may include legs 30 that support a pair of rails 32 extending along the horizontal frame 26. The rails 32 can provide a mounting point for the carriage 14. For example, the carriage 14 may include a platform 34 supported by rollers (not shown) that roll within channels along the rails 32. The carriage 14 may also include an adjustable headrest 36 and/or removable shoulder supports 38 located on top of the platform 34 for supporting a recumbent user. The reformer 10 may also include a standing platform 40 secured to the horizontal frame 26 proximate to the second end 26*b*. The reformer 10 may also include an adjustable foot bar 42 secured to the horizontal frame 26 proximate to the second end 26*b*.

The cord 22 has a proximate end connected to the carriage 14. From the carriage 14, the cord 22 extends to the lower guide 18 located proximate to the first end 26*a*. The cord 22 passes around the lower guide 18 and extends upward along the vertical frame 28 to an upper guide 20 (one upper guide 20 is shown for each of the two cords in FIG. 2). The cord 22 passes around the upper guide 20 such that the distal end of the cord 22 hangs from the upper guide 20. Reformer loops 24 are illustrated at the distal ends of the cords 22, and various straps, handles or other exercising implements can attached to the distal end of the cord 22. Passing around both the lower and upper guides 18, 20, the cord 22 is maintained generally out of the way. In some embodiments, the guides 18, 20 can be pulleys.

Figure 3:
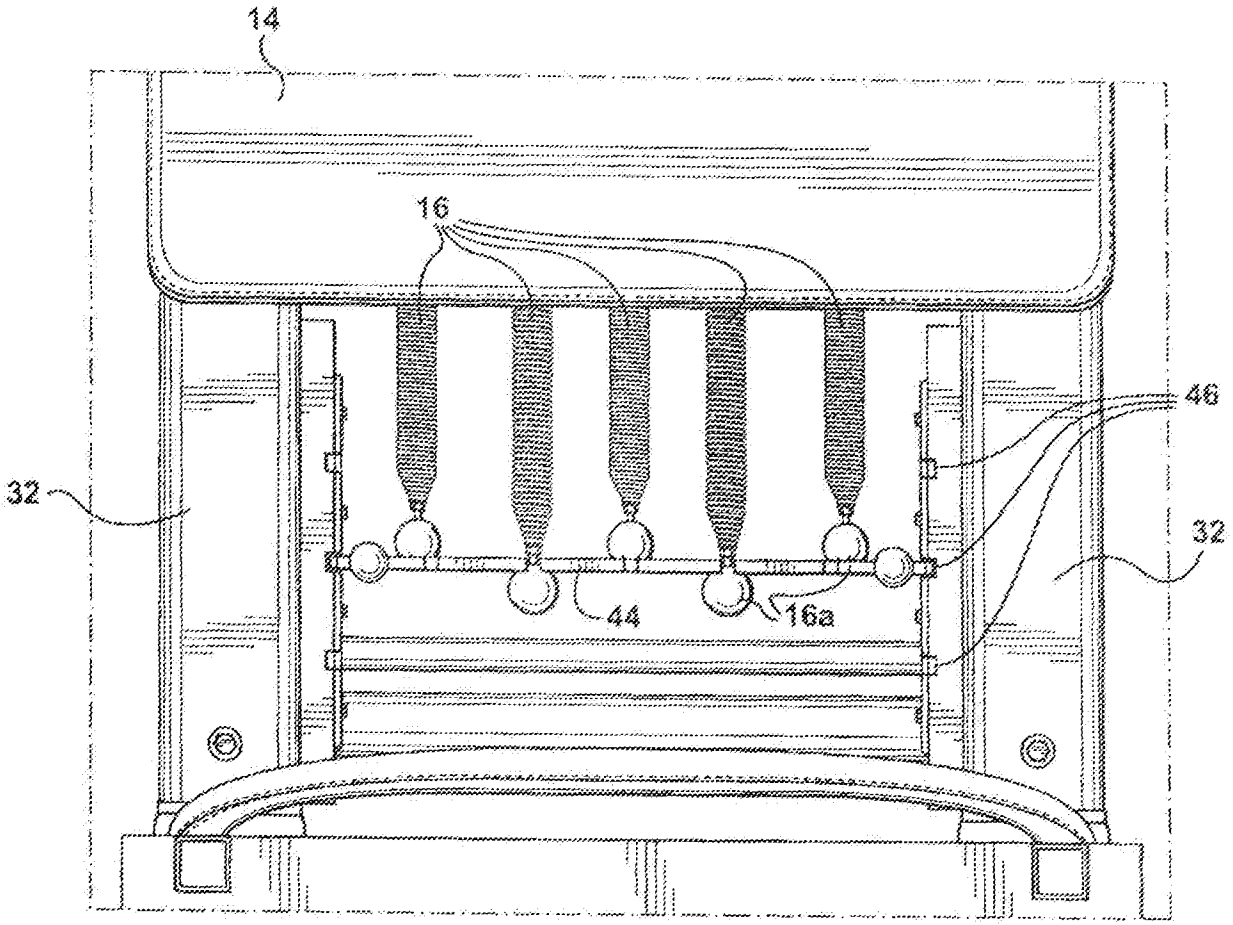
FIG. 3 is a top plan view of a resistance element connected between the horizontal frame and a carriage.

Referring to FIG. 3, at least one resistance element 16 connects the carriage 14 to the frame 12. As illustrated, the resistance element 16 may be in the form of a plurality of springs. When attached to both the carriage 14 and the horizontal frame 26, the resistance element 16 biases the carriage 14 toward an equilibrium position located between the first end 26*a* and second end 26*b* of the horizontal frame 26. If a user moves the carriage 14 away from the equilibrium position, the resistance from the resistance element 16 urges the carriage 14 back toward the equilibrium position. This provides a source of resistance that allows a user to perform exercises on the reformer 10.

The at least one resistance element 16 can be adjustable. As illustrated, each of the at least one resistance elements 16 may have one end 16*a* engageable with slots provided in a flange plate 44 (the flange plate 44 extending between rails 32 of the horizontal frame 26) such that each resistance element 16 is releasably attached to the horizontal frame 26. Another end of each of the resistance elements 16 (not shown) is attached to the underside of the carriage 14. Furthermore, as illustrated, the flange plate 44 can be removably secured between the rails 32, and can be adjusted between different positions 46 along the length of the horizontal frame 26 so as to change the resistance applied by the resistance element 16.

Figure 4:
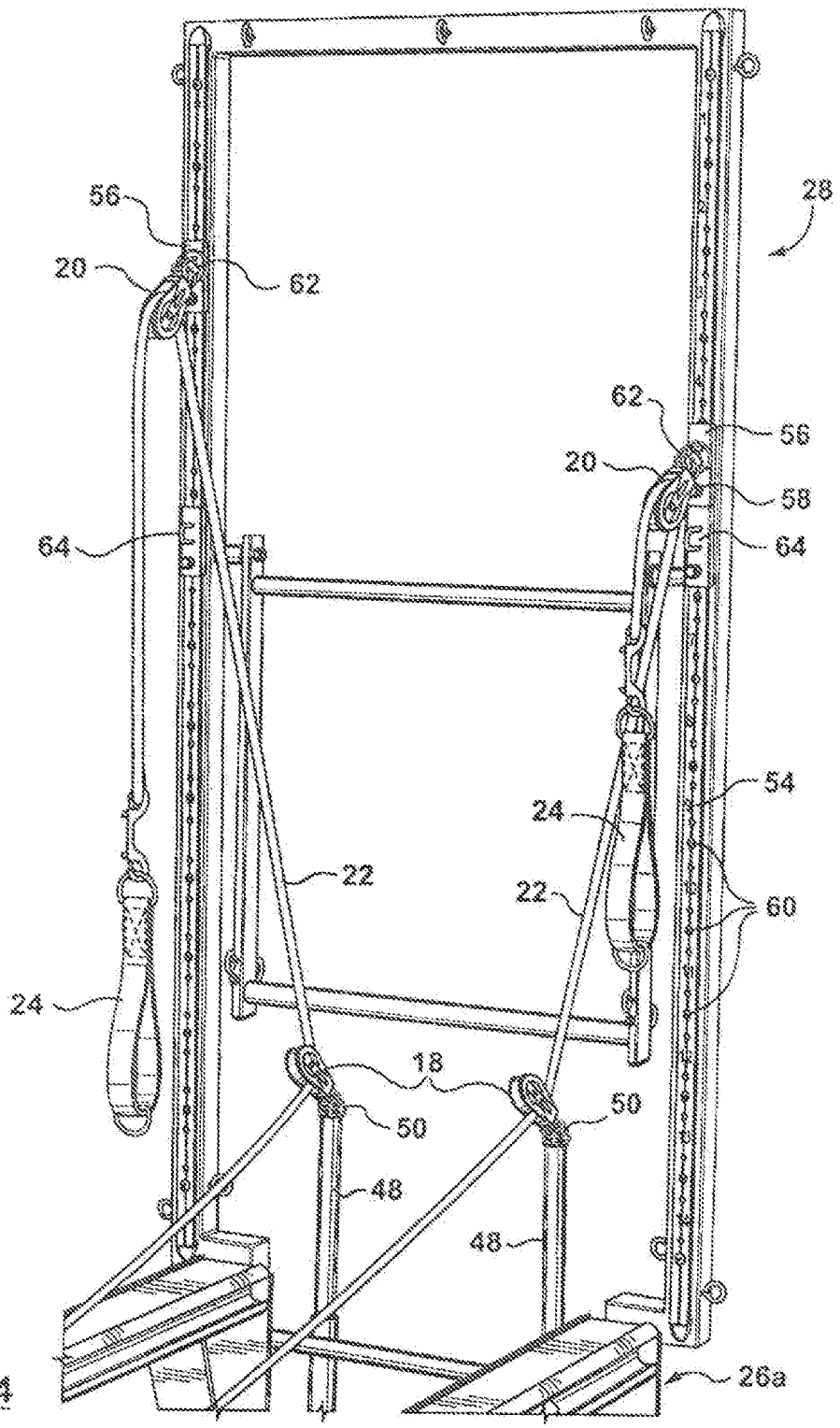
FIG. 4 is a close-up perspective view of the vertical frame.
Figure 5:
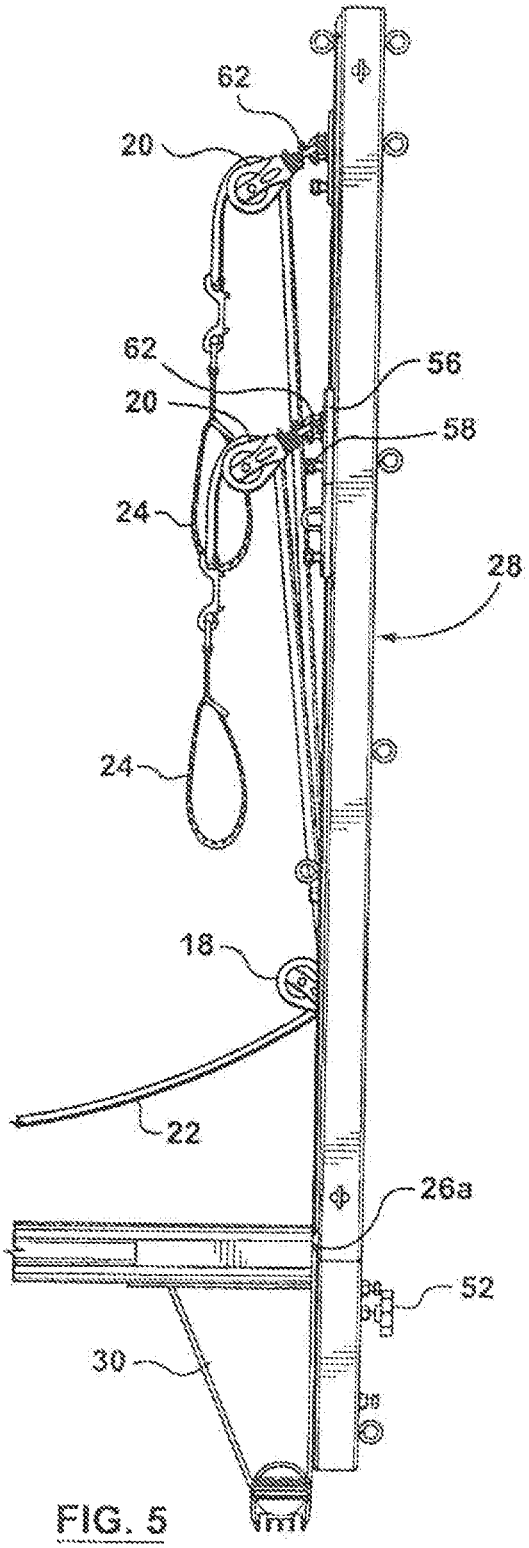
FIG. 5 is a close-up side elevation view of the vertical frame.

Referring to FIGS. 4 and 5, the lower guide 18 can be mounted to the frame 12 at a position proximate to the first end 26*a* of the horizontal frame 26. In particular, the lower guide 18 can be mounted to the top of a telescoping post 48, which can be mounted to the legs 30 of the horizontal frame 26. The top of the telescoping post 48 may include a swivel 50 that allows the lower guide 18 a range of movement. The telescoping post 48 allows adjustment of the height of the lower guide 18. The height of the lower guide 18 can be adjusted, for example, using a setscrew 52, which screws into the side of the telescoping post 48 to secure the telescoping post 48 in place. In other examples, the lower guide 18 may be mounted to the frame in other configurations, such as the configurations as described below for the upper guide 20. Furthermore, the lower guide 18 may be mounted to the vertical frame 28 or other parts of the frame 12.

The upper guide 20 can be adjustably mounted to the vertical frame 28. This allows the upper guide 20 to be secured to the vertical frame 28 at a plurality of different heights. In the illustrated example, the reformer 10 includes a track 54 affixed to the vertical frame 28 and a slider 56 that is adapted to move or slide up and down the track 54, for example along grooves in the track 54. The upper guide 20 is attached or mounted to the slider 56, such that moving the slider 56 allows adjustment of the height of the upper guide 20. To secure the slider 56 along the track 54, the slider 56 can include a pin 58 engagable with vertically spaced apart apertures 60 along the track 54. The pin 58 can be spring-loaded. As illustrated, the upper guide 20 may be adjustable in discrete steps defined by the spacing between each of the apertures 60. For example, the spacing between apertures 60 may be about 2, 1, or 0.5 inches, or any other suitable spacing between the minimum and maximum height of the upper guide 20.

When adjusting the height of the upper guide 20, a user retracts the pin 58 out of a respective aperture 60 on the track 54, moves the slider 56 to a new height, and reinserts the pin 58 into a new aperture 60 to secure the slider 56 at the new height. As illustrated, the track 54 may include numbering corresponding to the apertures 60 for ease of reference in setting the vertical position of the slider 56.

In other examples, the upper guides 20 may be mounted to the vertical frame 28 using different methods instead of tracks. For example, the upper guides 20 may be mounted to hooks that are spaced apart along the height of the vertical frame 28. In this example, the upper guides 20 may attach to the hooks using clips, such as carabineers. Alternatively, the upper guides 20 may be mounted to apertures along the height of the vertical frame 28 using keyed bolts or spring loaded bayonet connectors.

Adjusting the height of the upper guides 20 allows the user to pull the cord 22 from different heights and angles. For example, the upper guides 20 may be adjustable such that a user can pull the cord 22 downward toward the carriage 14 at a downward angle greater than 25 degrees relative to horizontal. In some examples, the height of the vertical frame 28 may allow adjustment of the upper guides 20 to a height between 0.1 meters and 1.5 meters above the carriage 14. When the upper guide 20 is adjustable to a height of 1.5 meters above the carriage 14, a user can generally perform exercises on the reformer 10 in rooms with standard height ceilings, which are typically 2.5 meters high (assuming the carriage 14 is approximately 0.5 meters high). Adjusting the height of the upper guides 20 also accommodates users of different heights and abilities. In other examples, the upper guides 20 may be adjustable to heights above 1.5 meters. Providing upper guides 20 with an adjustable height can allow a user to perform standing exercises, overhead exercises, and some arm exercises that are generally impracticable using conventional reformers.

In some examples, adjusting the height of the upper guides 20 may require shortening and lengthening of the cord 22 with respect to the carriage 14 and a distal end of the cord 22. Some methods of adjusting the length of the cord 22 are described below.

The lower guides 18 may be mounted to the frame 12 laterally inside the upper guides 20. Laterally offsetting the lower guides 18 relative to the upper guides 20 guides means that the cords 22 can slant outward from the lower guide 18 to the upper guide 20. The slanting of the cord 22 may reduce a likelihood of the cord 22 binding on the guides 18, 20.

The upper guide 20 may be mounted to the vertical frame 28 on a swivel 62 that is adapted to swivel or pivot. The swivel 62 allows the upper guide 20 a range of movement, and may reduce a likelihood of the cord 22 binding on the guide 20. The swivel 62 can allow the upper guide 20 to pivot from side-to-side as the cord 22 passes through the upper guide 20, which can be beneficial when a user pulls the cord 22 laterally outward. For example, as the cord 22 passes around the upper guide 20, the upper guide 20 can pivot from a first position where the cord 22 is approximately vertically oriented to a second position where the cord 22 is approximately horizontally oriented. Pivoting of the swivel 62 may reduce a likelihood of the cord 22 binding on the guide 20 because the orientation of the cord 22 is continuously in line with the pulling motion by the user. As mentioned above, the lower guide 18 may also be mounted to the frame 12 on a swivel 50. In some examples, the swivels 50, 62 may include a spring biasing the respective lower or upper guides 18, 20 to a particular orientation. For example, the swivel 62 may bias the upper guide 20 to a position where the cord 22 is vertically oriented.

The reformer 10 may also include one or more couplings 64 adjustably mounted to the vertical frame 28. The coupling 64 can be mounted to the vertical frame 28 in a manner similar to the slider 56. The coupling 64 allows a user to attach additional resistance members (not shown), such as leg spring straps or arm spring straps. These resistance members can provide another source of resistance, allowing a user to increase the resistance applied to particular muscle groups while using the reformer, or to provide resistance to multiple muscle groups. For example, a user may use both the resistance members and the cords 22 to increase development of core muscles, such as the abdominals. Alternatively, a user can perform exercises with opposing leg and arm movements using both the resistance members and the cords 22. A specific example of this exercise is where a user sits on the reformer 10 in a recumbent position with their head positioned toward the first end 26*a* of the horizontal frame 26. Prior to sitting down, the user attaches leg spring straps to the couplings 64 and adjusts the height of the couplings 64 such that the leg spring straps provide resistance from above for the user's legs. Typically, the height of the upper guides 20 provides resistance from above the user at approximately 45 degrees, but the particular angle will vary depending on the size of the user. While sitting, the user places the leg spring straps around their thighs such that the leg spring straps pull against the back of the user's thighs. In particular, the leg spring straps should provide tension when the carriage 14 is in the equilibrium position. With the leg spring straps providing tension, the user then grasps the distal ends of the cords 22 with their hands and pulls the cords 22 up and over their head toward their stomach in a semi-circular motion. As the user releases and returns their arms back above their head, tension from the leg spring straps activates the user's leg muscles. Accordingly, if a user moves the carriage 14 while exercising, the resistance from the leg spring straps may increase the intensity of the exercise by further activating the user's leg muscles. When performing this exercise increasing the height of the coupling 64 tends to increase the intensity of the exercise. Over time, progressively increasing the height of the upper guides allows for progressive rehabilitation of muscles. The resistance members may be used in similar ways for other exercises or targeting other muscles.

The various configurations of the guides 18, 20 on the vertical frame 28 described above, including the use of pulleys, swivels 50, 62, and laterally slanting cords 22, may allow smooth, unrestricted use of the reformer 10. The smooth motions can be useful for various exercises, as described below.

Figure 6:
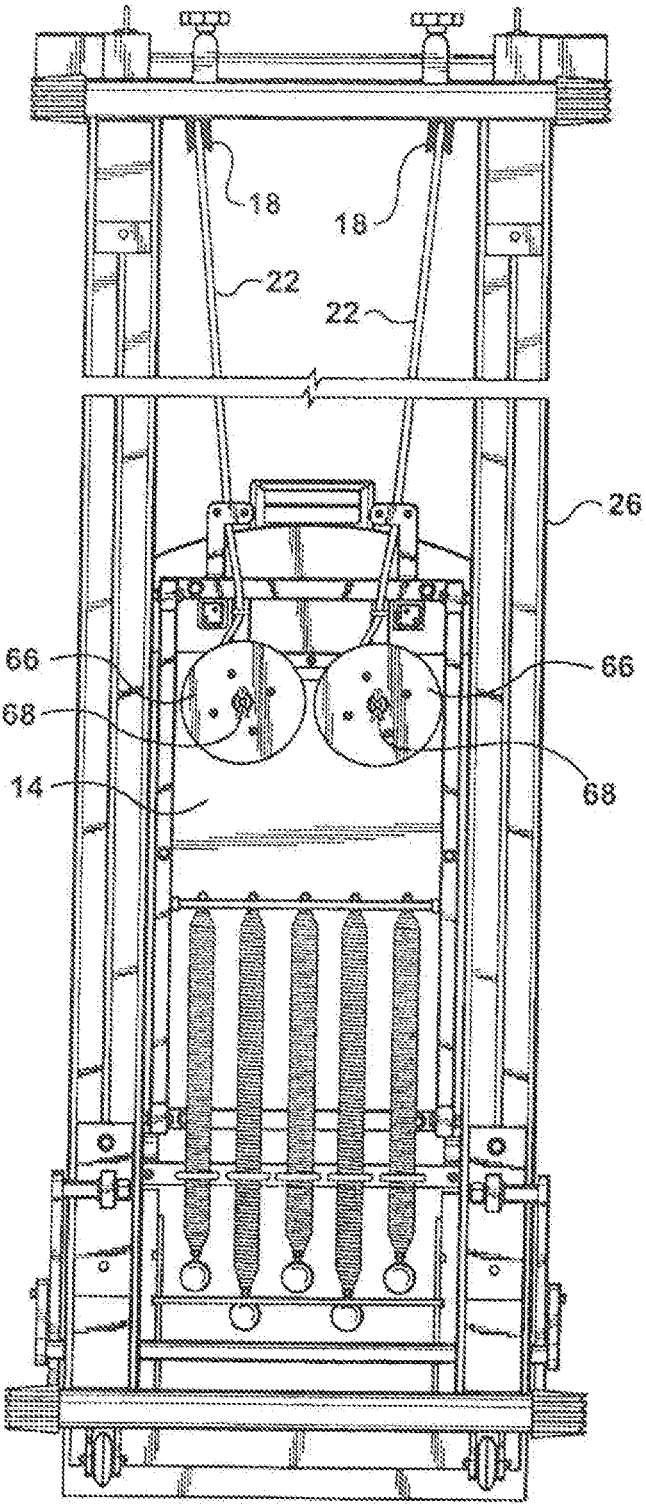
FIG. 6 is a bottom plan view of the of the reformer of FIG. 1.
Figure 7:
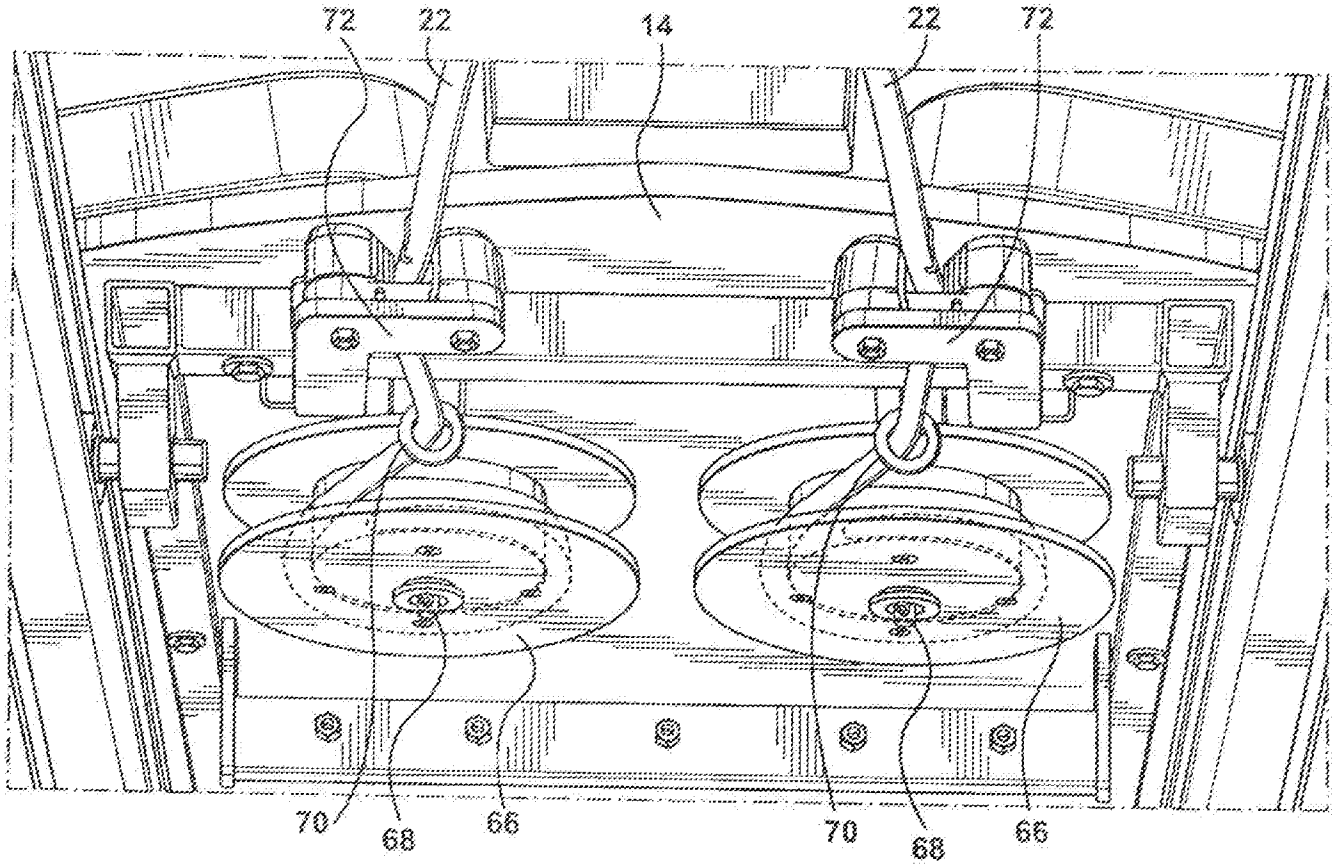
FIG. 7 is a bottom perspective view of a cord retraction system.

Referring now to FIGS. 6 and 7, the reformer 10 may also include a cord retraction system for pulling in slack from the cords 22. The cord retraction system may include a reel 66 mounted to the carriage 14 on an axle 68 (for example, the reel 66 can be held on the axle 68 using a cotter pin). In some embodiments, there can be two reels 66, one for each cord 22. The proximate end of each cord 22 generally attaches to the reel 66 such that the cord 22 can ravel around the reel 66 when the cord retraction system pulls in slack from the cord 22. A reeling mechanism (not shown) can also be provided automatic reeling of the cord 22 on to the reel 66. For example the reeling mechanism may be a motor, spring, or similar mechanism. In a particular example the reeling mechanism can include a coil spring similar to those used in car seat belt systems. One end of the coil spring can be attached to the reel 66 and the other end is attached to the axle 68. When there is slack, the coil spring rotates the reel 66 such that the cord 22 ravels around the reel 66 to retrieve slack from the cord 22. Pulling in slack maintains the cord 22 in tension and reduces clutter underneath the reformer 10.

As illustrated, the cord retraction system generally mounts to the underside of the carriage 14. In some examples the cord retraction system may be mounted to other parts of the reformer 10, such as the horizontal frame 26.

The cord retraction system may also include a raveling guide 70 attached to the carriage 14. The cord 22 passes through the raveling guide 70 before connecting to the reel 66. The raveling guide 70 orients the cord 22 prior to being wound, and may help reduce tangling of the cord 22. As illustrated, the raveling guide 70 may be a ring mounted to the carriage 14 a few inches from the reel 66.

While there is illustrated a reel 66 for each individual cord 22, the cord retraction system may be modified such that a single winch or drum winds up both cords 22. In other examples, the cord retraction system may have other configurations. For example, there may be a manual hand-crank that a user rotates in order to wind up the cords 22.

In some examples, when there is a cord retraction system, the reformer 10 may include a cleat assembly 72 that releasably secures the cord 22 to the carriage 14 (see FIG. 7). The cleat assembly 72 is adapted to allow the cord 22 to move in a direction towards the cord retraction system, but secures the cord 22 to prevent the cord 22 from being released from the cord retraction system. The cleat assembly 72 can be mounted to the underside of the carriage 14 adjacent to the reel 66. The cleat assembly 72 generally faces upward such that the user can secure and release the cord 22 from the cleat assembly 72 while standing above the reformer 10. With this configuration easy access to the cleat assembly 72 is provided while also keeping the cord 22 out of the way.

Figure 8:
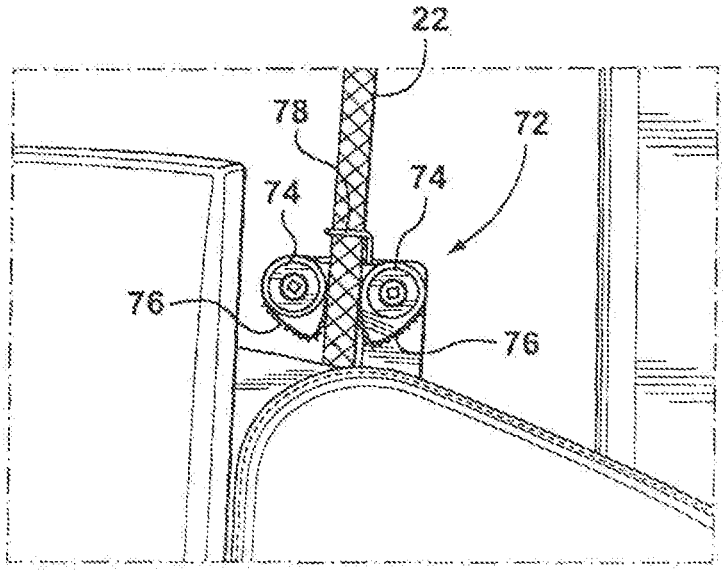
FIG. 8 is a close-up plan view of a cleat assembly.

Referring to FIG. 8, the cleat assembly 72 can include two adjacent cams 74 that are spaced apart such that the cord 22 fits within a gap between the cams 74. The cams 74 can be symmetrically oriented about the gap. Each of the cams 74 can have an oblong profile facing away from the cord retraction system. The cams 74 can also include ribs 76 along their circumference to grip the cord 22 within the gap. Each cam 74 may include a spring (not shown) for biasing the oblong surfaces toward each other to close the gap such that the ribs 76 pinch the cord 22. A rope guide 78 may be provided for maintaining the cord 22 within the gap between the cams 74. A user can secure the cord 22 to the cleat assembly 72 by pulling the cord 22 outward from cord retraction system and then pulling the cord 22 down into the gap between the cams 74. A user can release the cord 22 from the cleat assembly 72 by pulling the cord 22 down and laterally to clear the rope guide 78 (see FIG. 7) and then up and out from the cams 74.

In other examples, the cleat assembly 72 may have different configurations. For example, the cleat assembly 72 may include a tube and an adjustable clamp within the tube that can be depressed to secure or release the cord 22.

When the cleat assembly 72 secures the cord 22 to the carriage 14, the cord retraction system pulls in slack from the cord 22, reducing clutter underneath the carriage 14. To adjust the length of the cord 22, the user can release the cord 22 from the cleat assembly 72 and then pull on the cord 22 to release the cord 22 from the cord retraction system to obtain the desired length. To shorten the cord length, the user can hold the cord loosely and allow the cord retraction system to retrieve the cord 22 until a desired length is obtained. When either shortening or lengthening the cord 22, once the desired length is obtained the user can pull the cord 22 through the cams 74 in a direction away from the cord retraction system to secure the cord 22 between the cams 74 of the cleat assembly 72.

Adjustability of the length of the cord 22 may be helpful when performing certain exercises. By providing a system for quick adjustment of cord length, a user can set and configure the reformer 10 to provide tension throughout a complete range of motion. In some cases, a cord with a fixed length would result in a dead zone of tension at the beginning or end of an exercise motion. Using the reformer 10 having a cord retraction system as described above, a user can adjust the length of the cord to provide tension through the beginning and end of a motion depending on the specific exercise. Furthermore, adjustment can be done relatively quickly when the system includes a reel 66 adapted to automatically reel in the cord 22.

In use, the reformer 10 exhibits improved functionality that can allow a user to perform hundreds of exercises. Even more exercises are possible if, for example, a user installs a mat converter (not shown) to extend the length of the carriage 14. The mat converter essentially transforms the reformer into a mat or a trapeze table. In these configurations, a user can perform an even greater number of exercises.

The combination of the vertical frame 28 and adjustable upper guides 20 accommodates 3-dimensional ranges of motion while maintaining workout flow and maintaining constant resistance, without jarring. Altering the height of the upper guides 20 and angle of resistance can assist in developing balance, proprioceptively stimulating the neuromuscular system, and giving support to standing, kneeling and lunging exercises. In comparison to conventional reformers, the reformer 10 can allow for a greater number of exercises. For example, conventional reformers generally have an upper guide with a maximum height that is insufficient to permit some of the exercises described herein. Some specific examples of the exercises possible with the reformer 10 and variations thereof are described below.

A user can perform a method of exercising including adjusting the upper guide 20 to one of a plurality of heights, getting on the carriage, and pulling the distal end of a cord 22 along a range of motion, the cord connecting the carriage 14 and the upper guide 20 such that pulling the cord 22 causes horizontal movement of the carriage 14. Getting on the carriage 14 can include, for example, standing, sitting, kneeling, crouching, lying on the carriage 14, etc.

The reformer 10 and method of exercise described herein can help a user isolate specific muscles during an exercise. The isolation provided can be particularly beneficial in physiotherapy. The user can pull the cord 22 (e.g., using reformer loops 24) along a range of motion away and towards the upper guide 20. When the path of the cord 22 and the range of motion are parallel, the resistance from the reformer 10 directly opposes the force exerted by the user. This can help isolate specific muscles while performing some exercises. Parallelism also tends to increase the resistance throughout the range of motion because the displacement of the cord 22 and resistance element 16 tend to be the same as the range of motion. Conversely, when the path of the cord 22 and the user's range of motion deviate, the displacement of the cord 22 and resistance element 16 tend to be less than the range of motion. Less displacement of the resistance element 16 means there is less resistance. Furthermore, deviation between the path of the cord 22 and the range of motion means the resistance may not directly oppose the muscular force exerted by the user. This may activate other muscles and joints, which may not be desirable for users in physiotherapy.

Figure 9:
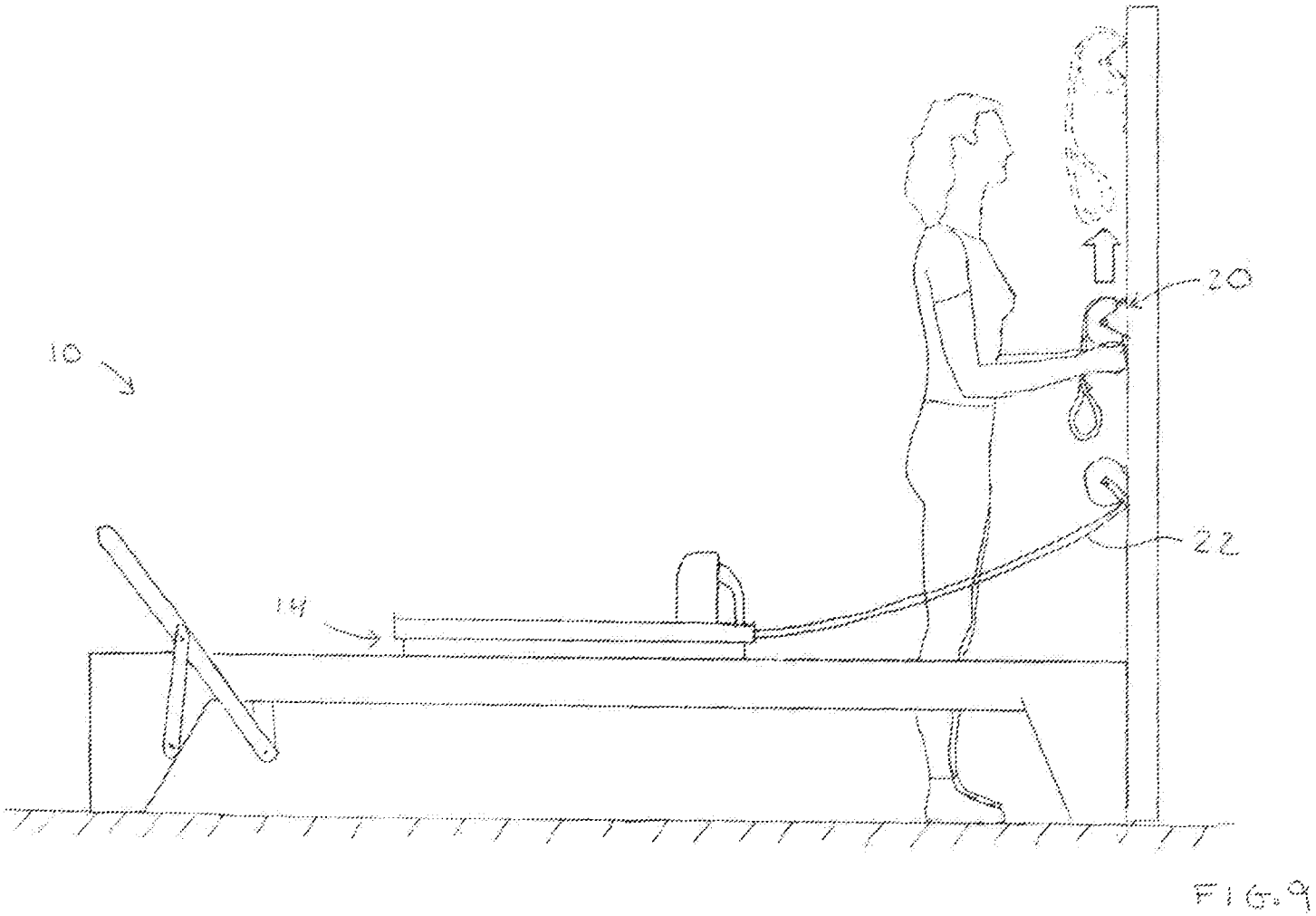
FIGS. 9-11 are a schematic representation showing an exerciser using the reformer of FIG. 1.
Figure 10:
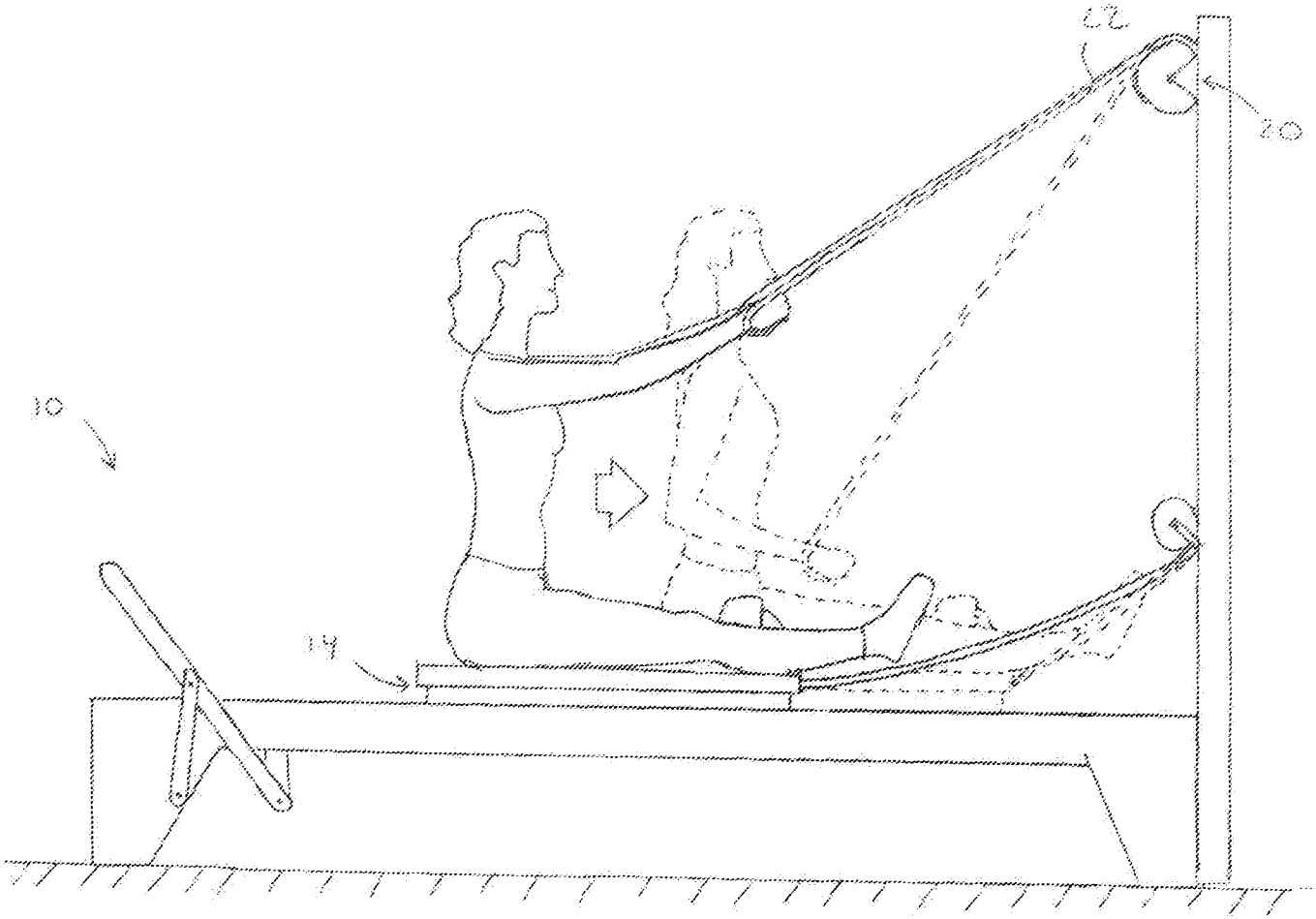
Figure 11:
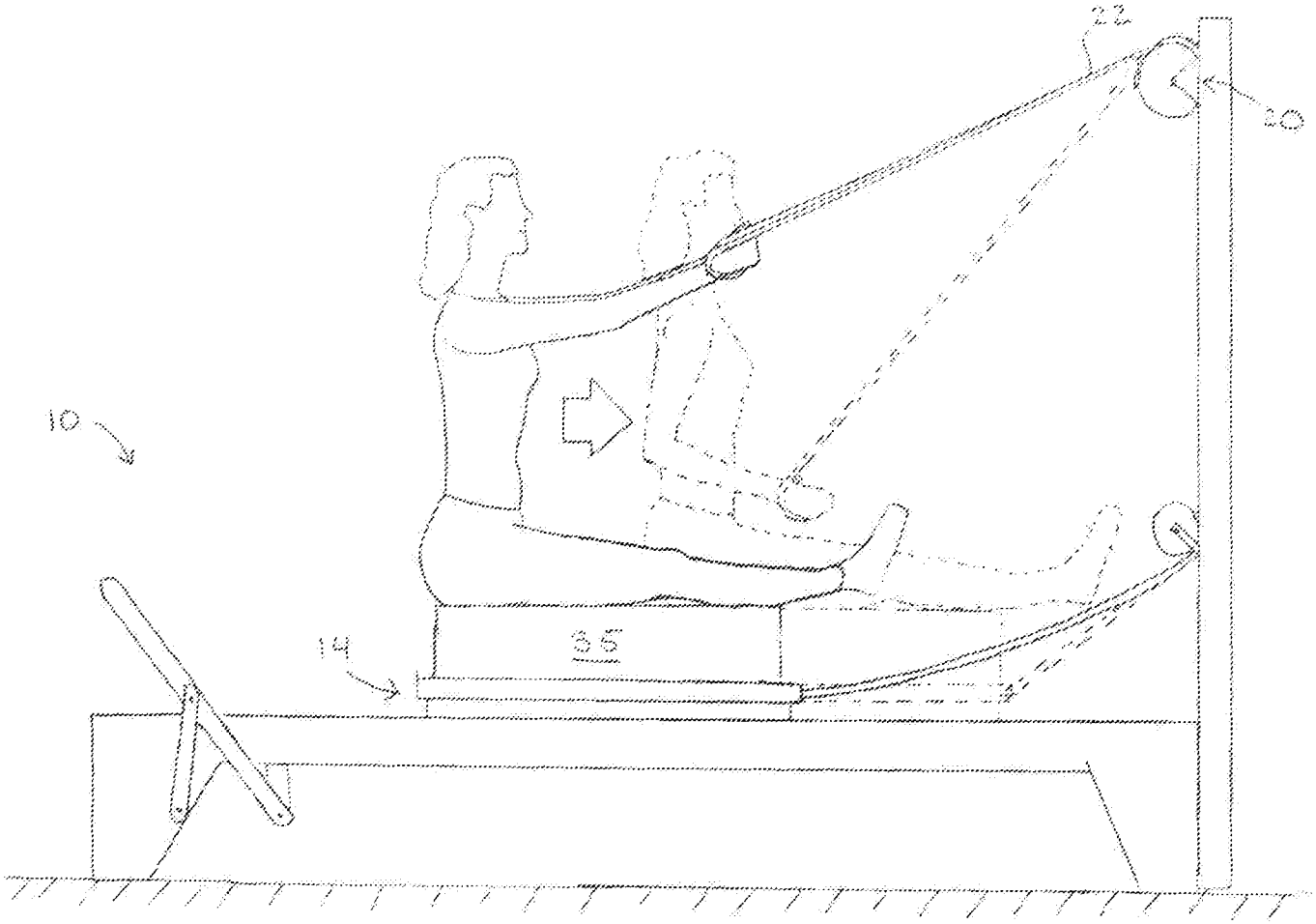

Providing the maximum adjustable height of the upper guides 20 at or above 1.5 meters allows a user to perform new exercises that were not possible on previous reformers. For example, and as illustrated in FIGS. 9-11, a user can get on the carriage 14 and pull the distal ends of the cords 22 toward the carriage 14 at a downward angle greater than 25 degrees. One example is an exercise for practicing a golf swing. In this example, a user stands on the carriage 14 and holds one cord 22 in both hands as if they were holding a golf club. For this exercise, the height of the upper guide 20 may provide resistance from above the user's hand through the golf swing. To perform the exercise, the user pulls the cord 22 through a motion representing a golf swing. Throughout the motion, the reformer 10 provides resistance, which can develop specific muscles for the user's golf swing. Another example is an exercise for practicing a baseball pitch. In this example the upper guides 20 may be set to provide resistance that is generally parallel to a motion representing a baseball pitch. To perform the exercise, a user holds the distal end of the cord 22 with one hand. The user then pulls the cord 22 over their head in a motion representing a baseball pitch. Throughout the motion, the reformer 10 provides resistance that can develop muscles for throwing a baseball pitch. Previous reformers generally did not accommodate these types of exercises because the cord 22 could not be pulled from a sufficient height for such exercises. For example, if the height of the upper guide 20 were lower than 0.5 meters (approximately waist level) a user performing an overhand baseball pitch would stress different muscles and joints than in a regular pitch because the resistance would come from below the user.

In general, when tension comes from below the user, the tension may activate muscles above the specific joints that are being strengthened. This is because the resistance effectively increases downward pressure on the joints. The user then must recruit accessory muscles above the joint to help stabilize the body part that is being exercised. For example, if the user is performing an exercise for the shoulder joint, and the cords are below the shoulder joint, the user may activate their deltoids and latissimus dorsi to aid in the movement and stabilize the shoulder joint, which may increase stress on the rotator cuff muscles. Activating these accessory muscles may reduce the effectiveness of some exercises and compromises the stability of the specific joint or body part. If the upper guides are placed at a position above or directly in line with the user's shoulder joint, depending on the specific user and their stability, the targeted muscles can be isolated and the joint can be worked effectively without placing undue stress on other muscles. This allows for a more effective exercise position and more stable joint complex.

Using the reformer 10 and methods of exercise described herein, a user can exercise with tension coming from above, inline or from below the specific joints and muscles being exercised. Depending on the user, they may need to stabilize their joints with tension coming from various angles. Having tension come from above the specific joint or muscle group can reduce the pressure on joints and body parts. Accordingly, a user can find a more effective position that will allow more natural movements of their joints and can properly stabilize their joints, by isolating specific muscles more effectively. For example, if the upper guides 20 are at a position above a user's shoulder during various arm exercises, there may be less tension on the user's rotator cuff and the user can stabilize the shoulder joint using their deep local stabilizers as opposed to trying to stabilize with the mobilizing or accessory muscles, such as the deltoids or latissimus dorsi muscles.

Similarly, providing tension from above can be beneficial for other exercises. For example, if a client has shortened hamstring or hip flexors they may be limited in the upper body exercises they can perform. They may be limited because the shortened hamstrings or hip flexors will not allow them to sit on the carriage 14 and perform typical upper body exercises without compromising the pelvic or spinal position. These upper body exercises may include those that challenge their deltoids, pectoralis major, rhomboids, trapezius, biceps and triceps. With the reformer 10, users can adjust the height of the upper guides 20 to allow the user to perform these exercises while sitting on a box 35 that is positioned on the carriage 14. Sitting on the box may allow for a more stable pelvic and spinal position while performing upper body exercises. Furthermore, the user can set the height of the upper guides 20 to provide resistance from above or in-line with the user's range of motion. As described above, this can inhibit stress on joints, muscles and other body parts. A user can use the box to raise the height of the carriage while also allowing adjustment of the upper guides 20 to a height appropriate to strengthen and condition specific muscles, without activating other muscles, in trying to achieve the appropriate exercise positions.

In one specific example, a user may perform abdominal exercises while sitting on the box in an upright position. The user holds the cords 22 in their hands and flexes forward. As the user leans, the reformer 10 provides resistance to the user's abdominals. In contrast to traditional sit-ups, exercising abdominals from an upright-seated position may reduce stress on the neck and shoulder musculature, as the user is not lifting their head off the floor against gravity. An upright-seated position will also put the user into a position which will allow them to stabilize the spine with the proper muscles, such as the transversus abdominus and multifidus, which will reduce stress and strain on the lower back, as the user is exercising in a more functional position. Reducing stress on the neck and shoulder muscles and joints, and providing stability to the spine and pelvis, is beneficial for users in physiotherapy or for elderly users.

Altering the angle of cord resistance can also target specific muscles in different manners than conventional reformers. For example, a user can perform exercises with 3-dimensional movements, such as leg circles, with varying resistance throughout the range of motion. To perform this exercise, the user lies on the carriage 14 with their back down and their head facing the first end **26*a* of the horizontal frame 26. In this position, the user attaches the cords 22 to their legs using reformer loops 24** adapted to fit their ankles.

If the user is a larger individual, they may not be able to perform a particular exercise with the resistance coming from below because the cords 22 may be impeded by their body. Likewise, if the user has restricted mobility in their hip joints, they may not be able to perform the exercise with the resistance coming from below because they may not be able to achieve the starting position due to the resistance of the cords 22. The height of the upper guides 20 can be set to provide resistance from above the user, for example, at a downward angle of approximately 35 degrees. The user can then rotate their legs in circles with the tension coming from above the user's body. If the user is a larger individual, the cords will not hit their body as the resistance is coming from above the user, and the cords are not close to the body. With the resistance coming from above, individuals with hip restrictions can find a starting position that does not require as much hip flexion, and can therefore also benefit from the 3-dimensional movement to help develop and stabilize muscles around the knee and hip joint.

While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

We claim:

1. A reformer comprising:

(a) a frame assembly including a horizontal frame having first and second ends, and a vertical frame secured to the horizontal frame proximate to the first end and extending upwardly from the horizontal frame;

(b) a carriage slidably mounted to the horizontal frame so as to reciprocate between the first and second ends;

(c) a resistance element attached to the carriage for biasing the carriage to an equilibrium position between the first and second ends;

(d) at least one cord guide mounted to the frame assembly proximate the first end of the horizontal frame;

(e) a cord connecting the carriage and the one or more cord guides;

(f) a resistance member coupling adjustably mounted to the vertical frame at a coupling height and repositionable along the vertical frame for adjusting the coupling height; and (g) a resistance member secured to the coupling.

2. The reformer of claim 1, wherein the resistance member coupling comprises a slider slidable along the vertical frame for adjusting the coupling height.

3. The reformer of claim 1, wherein the vertical frame includes a vertical track, and the resistance member coupling is slidable along the track for adjusting the coupling height.

4. The reformer of claim 3, wherein the vertical track has a plurality of apertures at different heights for positioning the resistance member coupling at any one of the different heights.

5. The reformer of claim 4, wherein the resistance member coupling includes a pin for engaging the plurality of apertures on the track to secure the resistance member coupling at any one of the different heights.

6. The reformer of claim 1, wherein the coupling height is adjustable to at least 0.5 meters above the horizontal frame.

7. The reformer of claim 1, wherein the resistance member comprises a spring strap.

8. The reformer of claim 7, wherein the spring strap comprises at least one of a leg spring strap and an arm spring strap.

9. The reformer of claim 1, wherein the cord guide is adjustably mounted to the frame assembly at a cord guide height and vertically repositionable relative to the frame assembly for adjusting the cord guide height.

10. The reformer of claim 9, wherein the cord guide height and the coupling height are independently adjustable.

11. The reformer of claim 9, wherein the cord guide is mounted to a post.

12. The reformer of claim 11, wherein the post is telescopic for adjusting the cord guide height.

13. The reformer of claim 11, wherein the cord guide is mounted to the post on a swivel.

14. The reformer of claim 9, wherein the cord guide is adjustably mounted to the vertical frame.

15. The reformer of claim 14, wherein the cord guide is slidable along the vertical frame for adjusting the cord guide height.

16. A reformer comprising:

(a) a frame assembly including a horizontal frame having first and second ends, and a vertical frame secured to the horizontal frame proximate to the first end and extending upwardly from the horizontal frame;

(b) a carriage slidably mounted to the horizontal frame so as to reciprocate between the first and second ends;

(c) a resistance element attached to the carriage for biasing the carriage to an equilibrium position between the first and second ends;

(d) at least one cord guide mounted to the frame assembly proximate the first end of the horizontal frame, the at least one cord guide and the carriage connectable through a cord extending from a first end for connection to the carriage, through the at least one cord guide, and to a second end for pulling by a user to urge translation of the carriage along the horizontal frame; and (e) a resistance member coupling adjustably mounted to the vertical frame at a coupling height and repositionable along the vertical frame for adjusting the coupling height, the resistance member coupling for connecting a resistance member to the vertical frame.

17. The reformer of claim 16, wherein the resistance member coupling is slidably mounted to the vertical frame and selectively slidable therealong for adjusting the coupling height.

18. The reformer of claim 16, wherein the cord guide is vertically translatable relative to the frame assembly for adjusting a cord guide height of the cord guide.

19. A reformer kit comprising:

(a) a frame assembly including a horizontal frame having first and second ends, and a vertical frame securable to the horizontal frame proximate to the first end and extending upwardly from the horizontal frame;

(b) a carriage slidably mountable to the horizontal frame so as to reciprocate between the first and second ends;

(c) at least one spring for connecting the carriage and the frame to bias the carriage to an equilibrium position between the first and second ends;

(d) at least one cord guide mountable to the frame assembly proximate the first end of the horizontal frame, the at least one cord guide and the carriage connectable through a cord extending from a first end for connection to the carriage, through the at least one cord guide, and to a second end for pulling by a user to urge translation of the carriage along the horizontal frame; and (e) a strap coupling mountable to the vertical frame for connecting an exercise strap to the vertical frame at a coupling height, the strap coupling repositionable to any one of a plurality of predetermined positions along the vertical frame for adjusting the coupling height.

20. The reformer kit of claim 19, wherein the strap coupling is slidable along the vertical frame for adjusting the coupling height.

21. The reformer kit of claim 20, wherein the vertical frame includes a vertical track, and the strap coupling comprises a slider slidable along the track for adjusting the coupling height.

22. The reformer kit of claim 21, wherein the vertical track has a plurality of apertures, each aperture at a respective predetermined position, and the strap coupling includes a pin for engaging any one of the plurality of apertures on the track to secure the slider at a respective predetermined position.

23. The reformer kit of claim 19, wherein the coupling height is adjustable to at least 0.5 meters above the horizontal frame.

24. The reformer kit of claim 19, wherein the exercise strap comprises a spring strap.

25. The reformer kit of claim 19, wherein the kit includes the exercise strap.

26. The reformer kit of claim 19, wherein the cord guide is adjustably mountable to the frame assembly at a cord guide height and vertically repositionable relative to the frame assembly for adjusting the cord guide height.

27. The reformer kit of claim 26, wherein the cord guide height and the coupling height are independently adjustable.

28. The reformer kit of claim 26, wherein the cord guide is mounted to a post.

29. The reformer kit of claim 28, wherein the cord guide is mounted to the post on a swivel.

30. The reformer kit of claim 26, wherein the cord guide is adjustably mountable to the vertical frame.

31. The reformer kit of claim 30, wherein the cord guide is slidable along the vertical frame for adjusting the cord guide height.

* * * * *